United States Patent [19]

Harris

[11] 4,259,760

[45] Apr. 7, 1981

[54] DEVICE FOR CLEANING COKE OVEN DOORS

[75] Inventor: Edward Harris, Pittsburgh, Pa.

[73] Assignee: Koppers Company, Inc., Pittsburgh, Pa.

[21] Appl. No.: 57,892

[22] Filed: Jul. 16, 1979

[51] Int. Cl.[3] ..... C10B 43/04

[52] U.S. Cl. ..... 15/93 A; 202/241

[58] Field of Search ..... 15/93 A; 202/241

[56] References Cited

U.S. PATENT DOCUMENTS

| | | | |
|---|---|---|---|
| 3,681,201 | 8/1972 | McCullough | 202/241 |
| 3,741,806 | 6/1973 | Stanke et al. | 15/93 A |
| 3,990,948 | 11/1976 | Lindgren | 202/241 |

*Primary Examiner*—Edward L. Roberts

*Attorney, Agent, or Firm*—Donald M. MacKay; Oscar B. Brumback; Herbert J. Zeh, Jr.

[57] ABSTRACT

The cleaning apparatus includes: (A) a cleaning head having a plurality of angled side by side chisel-like blades, the end sections of which are affixed to a pivotable member having one end portion secured to a frame member, said pivotable member allowing said blades to traverse an arcuate path, said cleaning head having a centrally located pivotable member for affixing cleaning head to a carriage and allowing for uniform loading of blades against surface to be cleaned; (B) a carriage for transporting the cleaning head in a reciprocal path across the periphery of an open door surface to be cleaned, pivotably connected to the cleaning head by the centrally located pivotable member and means for driving said carriage; and (C) a supporting ram affixed to the carriage on the side opposite from the cleaning head, and means for moving the carriage and cleaning head toward and away from the surface to be cleaned.

7 Claims, 5 Drawing Figures

DEVICE FOR CLEANING COKE OVEN DOORS

BACKGROUND OF THE INVENTION

Coke oven doors seal the opposite ends of conventional horizontal by-product coke oven batteries during the coking operation. These doors are removed during the pushing or removal of the coke charge. It is essential during the coking operation that a positive seal exist between each coke oven door and the door jamb in which it is positioned to prevent smoke emissions. To effect the seal, the frame of a conventional coke oven door has a raised knife edge sealing portion and adjacent planar portion that extends around the periphery of the door to mate with peripheral planar surfaces of the door jamb or the coke oven chamber. During the operation of the coke ovens, the planar surfaces of the doors become encrusted with a carbonaceous material of pitchy nature. Before the door is to be used again, this pitchy material must be removed to get a positive seal between the door and the underlying door jamb.

The corners of the door and jamb are curved and the known oven door cleaning devices are not effective in cleaning the arcuate corners of the doors. Consequently the carbonaceous material on the doors builds up and permits the escape of oven gasses. This invention obviates this disadvantage.

BRIEF DESCRIPTION OF THE INVENTION

Figure 1:
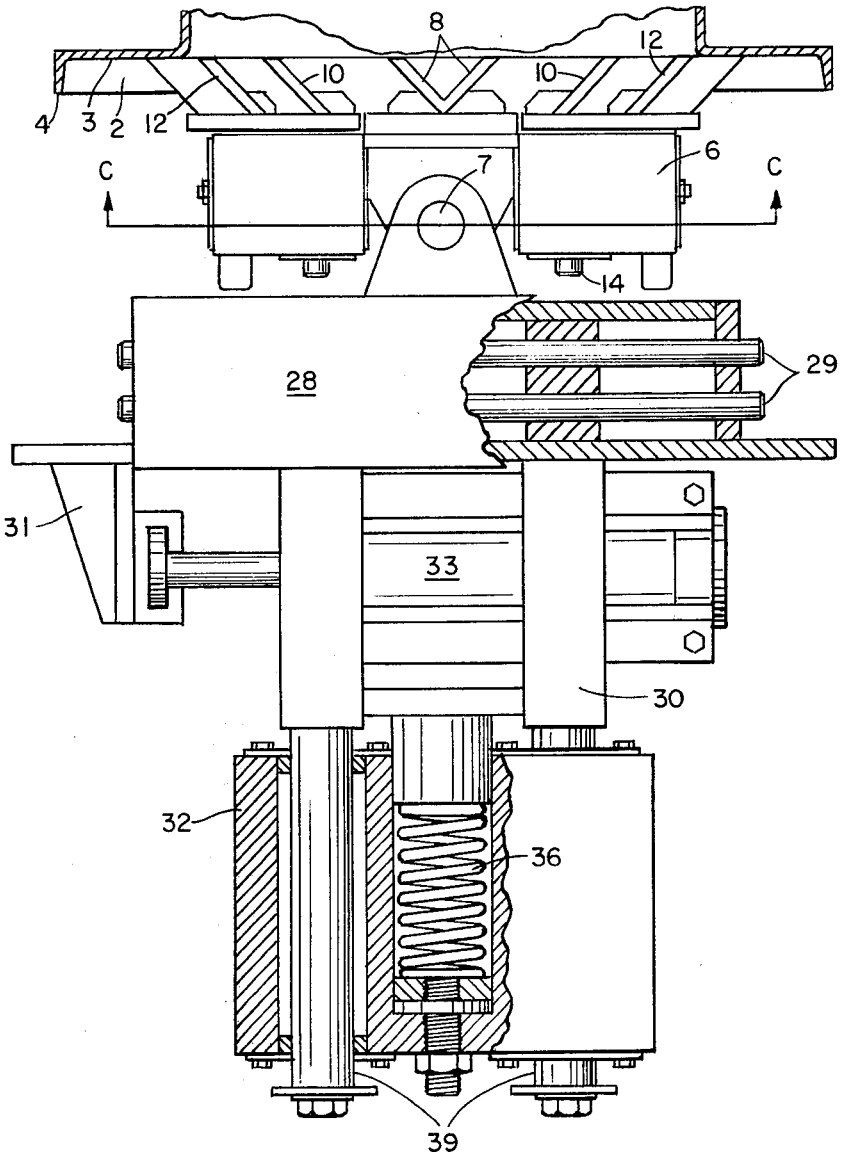
FIG. 1 is a bottom plan view in partial cross section of the cleaning apparatus for cleaning the planar surfaces of a coke oven door seal.
Figure 4:
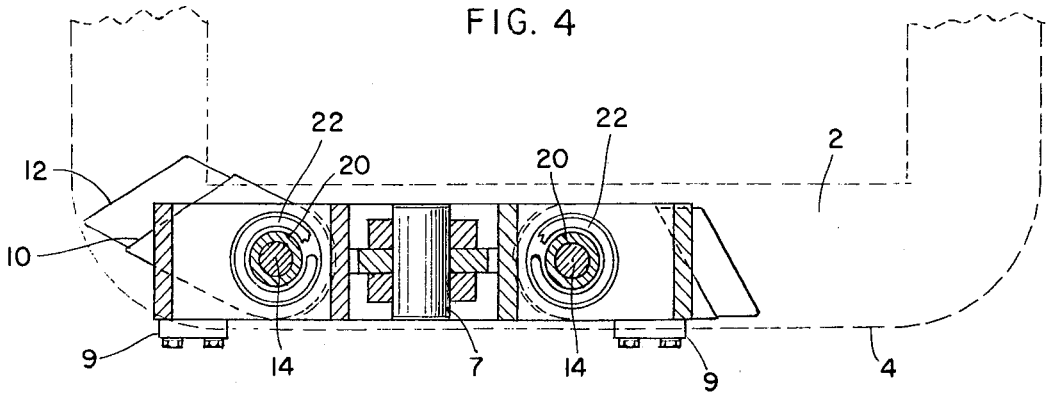
FIG. 4 is a cross section taken along line C—C of the end blades tracking a cammed surface.

Referring now to the drawings, there is illustrated in FIG. 1 a cross-sectional view of a conventional coke oven door seal designated by the numeral 2. The door seal comprises a planar surface 3 and a forwardly extending knife edge type surface 4. The junction between the vertical and horizontal portion forms arcuate corners (FIG. 4).

The planar surfaces 3 must be cleaned of all carbonaceous material so that an effective seal of the door can be established. In accordance with this invention, the cleaning of the seal planar surface is accomplished by way of a cleaning head 6 having a body portion that holds a plurality of angled side-by-side chisel-like blades 8, 10, and 12. The side blades 10 and 12 pivot about a pin 14 to traverse an arcuate path and clean the arcuate corners 5 of the door seal 2. The cleaning head is connected by pivot 7 to the carriage 28. By way of ram 33 the carriage reciprocates the head 6 across the periphery of the oven door surface 3 to be cleaned and provides for the uniform loading of blades against sealing surfaces to be cleaned. An additional ram 32 moves the carriage and cleaning head toward and away from the surface to be cleaned.

DETAILED DESCRIPTION OF THE INVENTION

Figure 2:
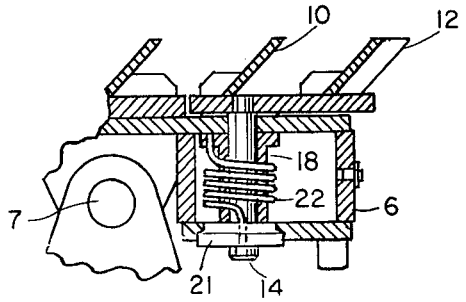
FIG. 2 is a view in section of a pivotable end blade of FIG. 1.

Chisel-like blades 8, 10, and 12 are spaced from each other on cleaning head 6 and in diverging relation to each other. The blades to remove the carbonaceous deposits from the horizontal planar surface contact and overlap portions of the planar surface when the head is reciprocated. The center pair of blades 8 are rigidly fixed to the cleaning head. The end pair of blades 10 and 12, FIG. 2, oscillate about a pivot pin 14 mounted through a fixed member 6, preferably by an antifrictional device such as a bushing (incorporated at either end) of fixed member 6 to provide antifrictional rotation of pivotable member 14.

The affixed pivotable member is sleeved with a flanged collar 20 affixed to the pivotable member with a key 18 in a manner which allows it to rotate with pivotable end section blade pairs 10 and 12. The flanged portion of collar 20 will accept a torsional spring stem. A torsional spring 22 is utilized around collar 20 with one stem end inserted into a collar flange, and the other stem end inserted into a non-rotating member 21 incorporated in fixed member 6. The torsional spring 22 may be preloaded to a predetermined load by inserting the stem portion of the torsional spring 22 into a selected position incorporated in non-rotating member 21. The preloaded spring is contained by stops 9 affixed to fixed member 6.

Figure 3:
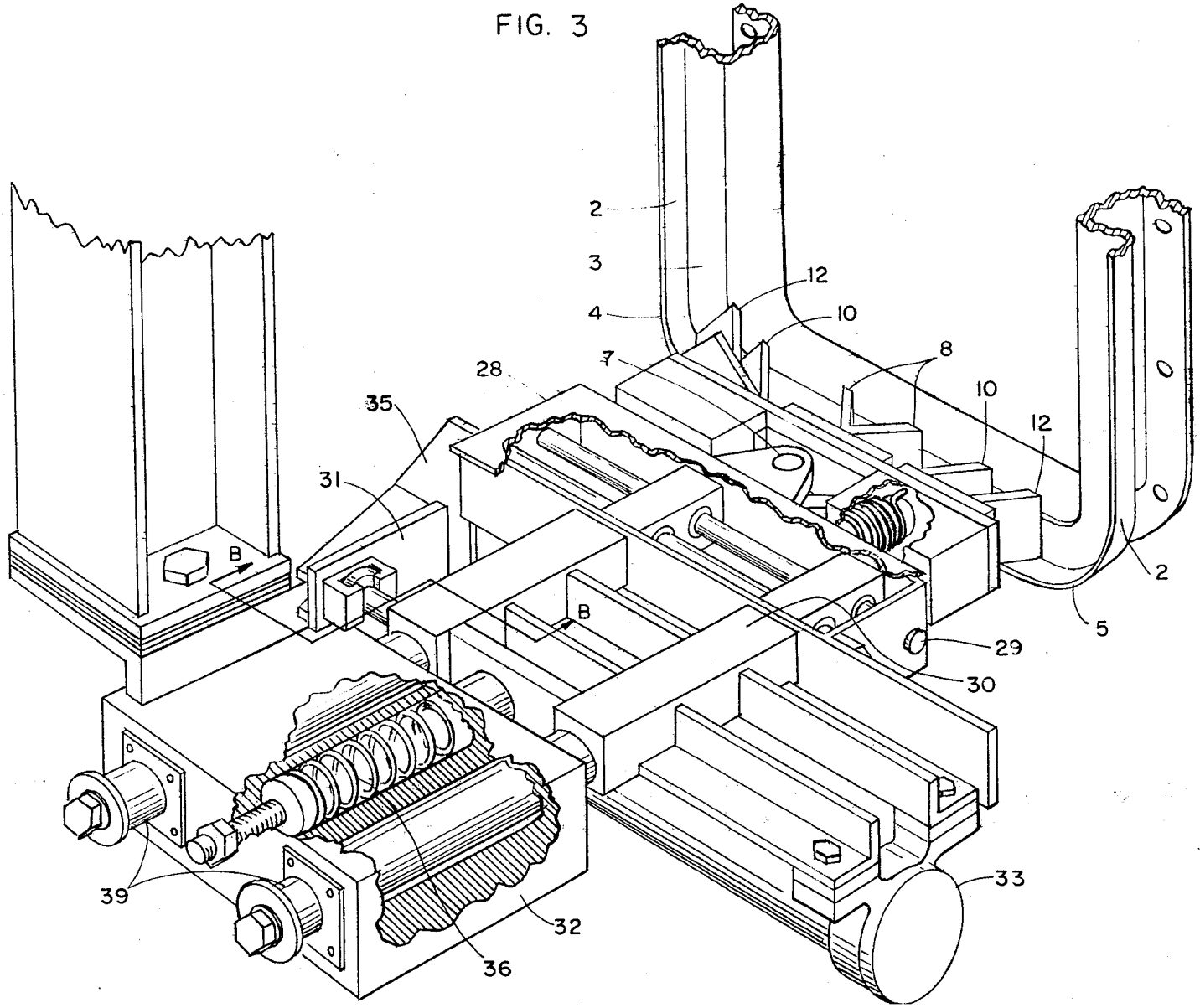
FIG. 3 is an isometric view partly in section and partly broken away of the cleaning apparatus.

The cleaning head 6 has a centrally located pivotable member 7 for affixing cleaning head to carriage 28 and allowing for uniform loading of blades against surface to be cleaned. The complete cleaning head, in conjunction with carriage 28, will move back and forth across planar surface 3, a predetermined amount. As cleaning head 6 approaches one end of the sealing strip, the pivotal end blades make contact with the radiused flanged portions of sealing strip and ride radius, as shown in FIG. 3, with one side so as to insure cleaning of the corners as well as the planar surface. As cleaning head is moved back from radiused portion of sealing strip, the pivotal end section will return to stop position (blades in line) due to torsional spring.

The carriage 28 is a means of conveying the cleaning head 6 back and forth across the planar surface 3. The carriage is guided back and forth on rollers and/or slides 29 affixed to said carriage. The slides and/or rollers in conjunction with carriage traverse axially through positioned apertures. Incorporated in the carriage assembly is a type bracket 31 which, in conjunction with a ram 33, provides the means to traverse the carriage axially. A portion of the cleaning head support structure is shown at 30.

Figure 5:
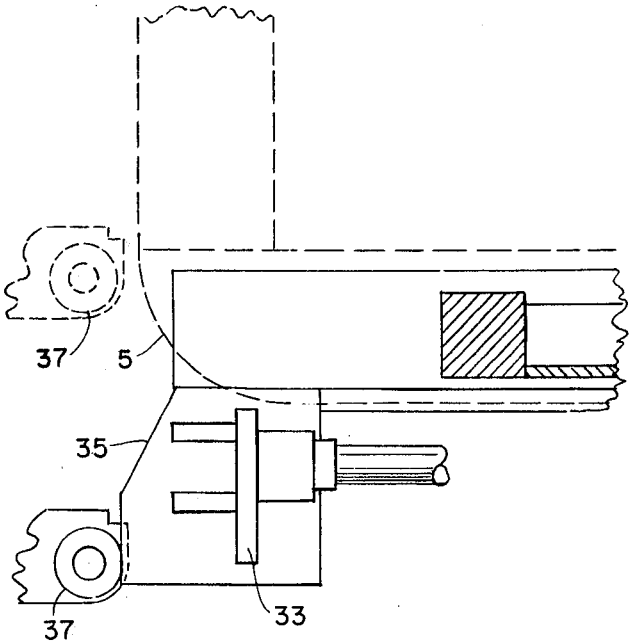
FIG. 5 is a cross section taken along line B—B showing the side guide bar.

Affixed to the ends of carriage is a sloped guide bar 35 (FIG. 5) which in conjunction with rollers 37 mounted on adjacent cleaning apparatus will insure, in the event of a cylinder valve malfunction, that carriage is returned to center position. Thus, operation of adjacent cleaning apparatus is guaranteed without interfering with miscentered cleaning head 6 as the rollers "ride" the guide bars so as to force the cleaning head to a center position. The carriage is also enclosed in a metal body to prevent contamination from tar, grit, and other matter related to coke oven service.

The ram 30 is the means for supporting carriage with affixed rollers and/or slides and cleaning head for movement of carriage assembly back and forth across cleaning surface and to and from cleaning surface. It is also used to mount the carriage operating cylinder 33, and to maintain a constant pressure between the seal planar surface and cleaning head while cleaning head is in operation.

The carriage rollers and/or slides are located at end of the ram nearest seal planar surface. Uniform loading between cleaning head and seal planar surface is accomplished by means of a spring or cylinder 36 reacting between support ram 32 and a horizontal base and positioned between twin joined shafts 39 which provide for movement toward or away from seal planar surface. The center load is externally adjustable for higher or lower cleaning head pressure against seal planar surface. The ram twin shafts and spring assembly are housed in a horizontal base which is connected to a door cleaner machine main frame.

While the invention has been illustrated by the preferred embodiments, numerous obvious modifications will occur to those of ordinary skill in the art and thus the invention is to be limited only by the appended claims.

What is claimed:

1. A coke oven door scraper comprising:

(a) a cleaning head having an elongated body portion that holds a plurality of longitudinally angled chisel-like blades for contacting a coke oven door seal planar surface, said blades forming an acute angle in scraping relationship with said surface and including an end blade which pivots around a curved surface of said coke oven door seal to follow and clean said curved surface.

(b) pivotal means to allow said end blade to pivot from a linear position around said curved surface and back, and (c) means for returning said pivotal end blade from the curved surface to a linear position.

2. The apparatus of claim 1 additionally comprising a carriage affixed to said cleaning head for reciprocating said head across the periphery of the coke oven door seal planar surface.

3. The apparatus of claim 1 wherein the cleaning head comprises a center pair of rigidly fixed blades, and a pivotable pair of blades at each end of the cleaning head which pivotable blades are constrained by a torsional spring and a stop, said torsional spring comprising said means for returning said pivotal end blades from the curved surface to the linear position, and affixed to said pivotable blades and a non rotating member of said head, and said stop affixed to said head in the path of movement of said pivotable blades.

4. The apparatus of claim 2 wherein the carriage is affixed to the cleaning head by means of a centrally located pivotable member.

5. The apparatus of claim 2 additionally comprising means for driving said carriage to reciprocate the cleaning head across the seal planar surface.

6. The structure of claim 2 additionally comprising means for moving the carriage and cleaning head toward and away from the surface to be cleaned, and maintaining a constant pressure between the seal planar surface and cleaning head while cleaning head is in operation.

7. The structure of claim 2 additionally comprising sloped guide bars affixed to the ends of the carriage for contact with rollers mounted on an adjacent cleaning apparatus to move the carriage.

* * * * *